United States Patent [19]

Osburg

[11] 4,218,943

[45] Aug. 26, 1980

[54] REVOLVING CROSS CUTTER

[75] Inventor: Dieter Osburg, Neuss-Weckhoven, Fed. Rep. of Germany

[73] Assignee: Jagenberg Werke Atkiengesellschaft, Dusseldorf, Fed. Rep. of Germany

[21] Appl. No.: 932,072

[22] Filed: Aug. 8, 1978

[30] Foreign Application Priority Data

Sep. 28, 1977 [DE] Fed. Rep. of Germany ..... 2743561

[51] Int. Cl.[2] ..... B26D 7/22

[52] U.S. Cl. ..... 83/304; 83/528; 83/564

[58] Field of Search ..... 83/61, 62, 64, 66, 67, 83/304, 305, 528, 564, 563

[56] References Cited

U.S. PATENT DOCUMENTS

| | | | |
|---|---|---|---|
| 3,420,084 | 1/1969 | O'Brein et al. | 83/564 X |
| 3,744,361 | 7/1973 | Van Doorn | 83/62 X |
| 4,058,041 | 11/1977 | Ifo | 83/305 |

*Primary Examiner*—J. M. Meister

*Attorney, Agent, or Firm*—Sprung, Felfe, Horn, Lynch & Kramer

[57] ABSTRACT

A revolving cross cutter has two knife drums coupled together, wherein the upper knife drum is mounted for movement towards and away from the lower drum for setting a gap between the two. A sensor-controlled lift mechanism is responsive to forcible lifting of the upper knife drum to lift same away from the lower drum when a jam-up occurs.

5 Claims, 1 Drawing Figure

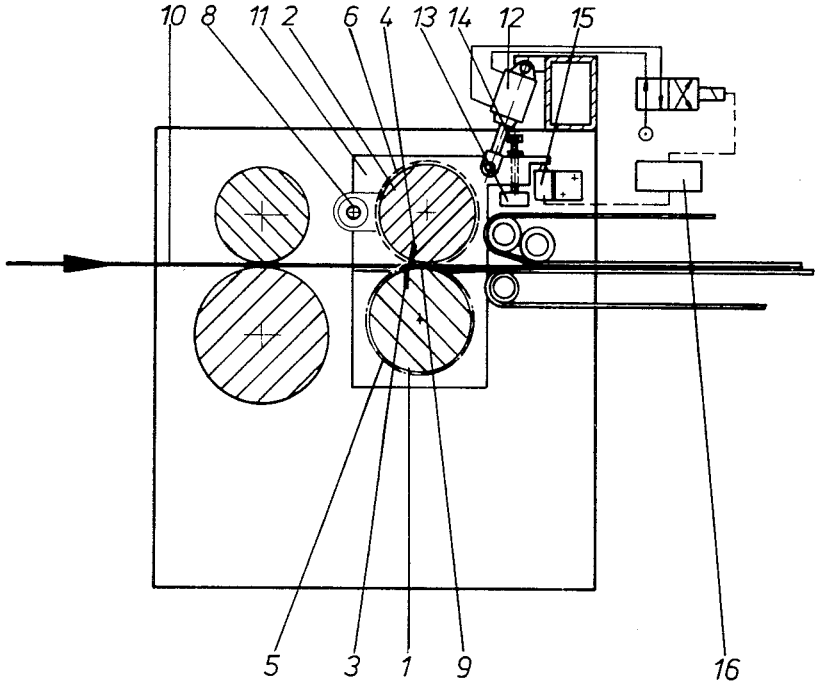
10
8
11
2
6
4
13
14
12
15
5
3
1
9
16

REVOLVING CROSS CUTTER

BACKGROUND

The invention relates to a revolving cross cutter having two knife drums coupled together especially by gears.

In known revolving cross cutters of this kind, which are referred to as synchronous cross cutters, the knife drums are fixedly mounted in the machine frame. In the event of a material jam-up they are unable to yield. This often results in damage to the knife drums and to other machine parts.

THE INVENTION

The object of the invention is to impove a revolving cross cutter of the above-mentioned kind such that neither the knife drums nor any other machine parts will be damaged in the event of a material jam-up.

This object is achieved in accordance with the invention in that the upper knife drum is yieldingly mounted in the machine frame and can be lifted by a sensor-controlled lift means whose sensor responds to a forcible lifting of the upper knife drum.

In the revolving cross cutter of the invention, the upper knife cylinder can yield to a material jam-up. This forcible displacement of the upper knife drum produces a control signal from the sensor controlling the lift means which then lifts the upper knife drum.

It is desirable that the upper knife have a pivoted mounting in the machine frame and that it rest on a stationary stop. The lift means is preferably a cylinder-and-piston system which can be extended and retracted by the sensor and which urges especially the upper knife drum against the stationary stop. The upper knife drum is in this case liftable against its own weight and the adjustable pressure of the piston-and-cylinder system in the event of a material jam-up.

Since the sensor must react to the slight lifting, it can be in the form, for example, of a microswitch.

THE DRAWING

The invention will now be further explained with the aid of a FIGURE representing an embodiment in cross section.

DETAILED DESCRIPTION OF THE INVENTION

The revolving cross cutter has a lower knife drum 1 and an upper knife drum 2. Each knife drum 1 and 2 is equipped with a knife 3 and 4. The lower knife drum 1 and the upper knife drum 2 are coupled together through gears 5 and 6, so that they rotate in synchronism. While the lower knife drum 1 is fixedly mounted in the machine frame 7, the upper knife drum 2 is mounted so as to be able to pivot up and down in the machine frame 7. Such pivoting of the upper knife drum 2 can therefore enlarge the gap 9 for the accommodation of the paper web to be cut.

The upper knife drum 2 or its bearing plate 11 is engaged by a lift means 12 in the form of a double-acting cylinder-and-piston system. In the position represented in the drawing, the lift means is urging the bearing plate 11 against a stationary stop 13. By means of an adjusting screw 14, the position of the bearing plate 11 and hence of the upper knife drum 2 can be adjusted.

A microswitch 15 is associated with the bearing plate 11 and the stationary stop 13. As long as the upper knife drum 2 is resting with its bearing plate 11 against the stationary stop 13, the microswitch 15 given no operating signal. If, however, a material jam-up occurs in the web of goods 10, slightly lifting the upper knife drum 2, the microswitch 15 opens and, through a control means 16, reverses the pressure delivered to the cylinder and piston system 12, so that the latter no longer urges the upper knife drum 2 against stop 13 with a predetermined pressure, but lifts the upper knife drum 2 upwardly. Thus the gears of the two knife drums 1 and 2 are disengaged and the gap 9 is enlarged such that a material jam-up can neither block the drums nor cause other damage to the revolving cross cutter.

It will be appreciated that the instant specification and claims are set forth by way of illustration and not limitation, and that various changes and modifications may be made thereto without departing from the spirit and scope of the present invention.

What is claimed is:

1. A revolving cross cutter having two knife drums coupled together, means mounting the upper knife drum for movement towards and away from the lower drum for setting a desired gap between the two and sensor-controlled lift means for maintaining the upper drum at the desired spacing from the lower drum and responsive to forces tending to lift the upper knife drum away from the lower drum to immediately automatically lift the upper drum away from the lower drum to a distance sufficient to remove the action of the forces on the upper drum.

2. The revolving cross cutter according to claim 1, wherein the mounting means comprises means pivotally mounting the upper drum and a stationary stop for limiting the pivotal movement to determine the gap.

3. The revolving cross cutter according to claim 2, wherein the lift means comprises a double-acting cylinder-and-piston system.

4. The revolving cross cutter according to claim 3, wherein the upper knife drum is urged by the lift means against the stationary stop.

5. The revolving cross cutter according to claim 1, wherein the lift means includes a sensor comprising a microswitch.

* * * * *